US008359862B1

(12) United States Patent
Sellin

(10) Patent No.: US 8,359,862 B1
(45) Date of Patent: Jan. 29, 2013

(54) STEAM TURBINE ENGINE

(76) Inventor: Denny Sellin, Wichita, KS (US)

( * ) Notice: Subject to any disclaimer, the term of this patent is extended or adjusted under 35 U.S.C. 154(b) by 791 days.

(21) Appl. No.: 12/499,354

(22) Filed: Jul. 8, 2009

(51) Int. Cl.
*F01K 23/06* (2006.01)
*F01B 7/20* (2006.01)
*F01B 15/00* (2006.01)

(52) U.S. Cl. ..... 60/670; 91/169; 92/66

(58) Field of Classification Search ..... 60/516–526, 60/641.1–641.15, 614–622, 645–681; 91/216 R, 91/217, 216 A, 216 B, 265, 271, 272, 273, 91/326–331; 92/51, 66, 117 R, 117 A
See application file for complete search history.

(56) References Cited

U.S. PATENT DOCUMENTS 1,088,156 A * 2/1914 Luginbrehl ..... 91/173
1,906,095 A * 4/1933 Prentice ..... 123/50 R

* cited by examiner

*Primary Examiner* — Kenneth Bomberg
*Assistant Examiner* — Christopher Jetton
(74) *Attorney, Agent, or Firm* — Michael I. Kroll

(57) ABSTRACT

A steam turbine engine that converts highly compressed steam to mechanical rotatative torque. An upper sealing gate and lower sealing gate alternately open and block the intake port and exhaust port accordingly through the use of a lever arm and cam and pulley system.

7 Claims, 8 Drawing Sheets

STEAM TURBINE ENGINE

BACKGROUND OF THE INVENTION

1. Field of the Invention

The present invention relates generally to engines and, more specifically, to a steam turbine engine which converts highly pressurized steam to rotative mechanical energy.

2. Description of the Prior Art

There are other engines that may be suitable for the purposes for which they were designed, they would not be as suitable for the purposes of the present invention, as hereinafter described.

SUMMARY OF THE PRESENT INVENTION

A primary object of the present invention is to provide an engine that operates under the power of highly pressurized steam.

Another object of the present invention is to provide a steam turbine engine having a reciprocating piston that rotates a crank shaft via a plurality of cams and springs.

Yet another object of the present invention is to provide a steam turbine engine wherein momentive force returns the piston to the origin position.

Still yet another object of the present invention is to provide a steam turbine engine that is green and doesn't use any fossil fuels to operate.

Still yet another object of the present invention is to provide a steam turbine engine that is inexpensive to manufacture and operate.

Another object of the present invention is to provide a steam turbine engine that is simple and easy to use.

Additional objects of the present invention will appear as the description proceeds.

The present invention overcomes the shortcomings of the prior art by providing a steam turbine engine that converts highly compressed steam to mechanical rotatative torque. An upper sealing gate and lower sealing gate alternately open and block the intake port and exhaust port accordingly through the use of a lever arm and cam and pulley system.

The foregoing and other objects and advantages will appear from the description to follow. In the description reference is made to the accompanying drawings, which forms a part hereof, and in which a lifting embodiment is assumed in practicing the invention. It is to be understood that various lifting embodiments exist or may be devised to enable those skilled in the art to practice the invention and that structural changes to accommodate said embodiments may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
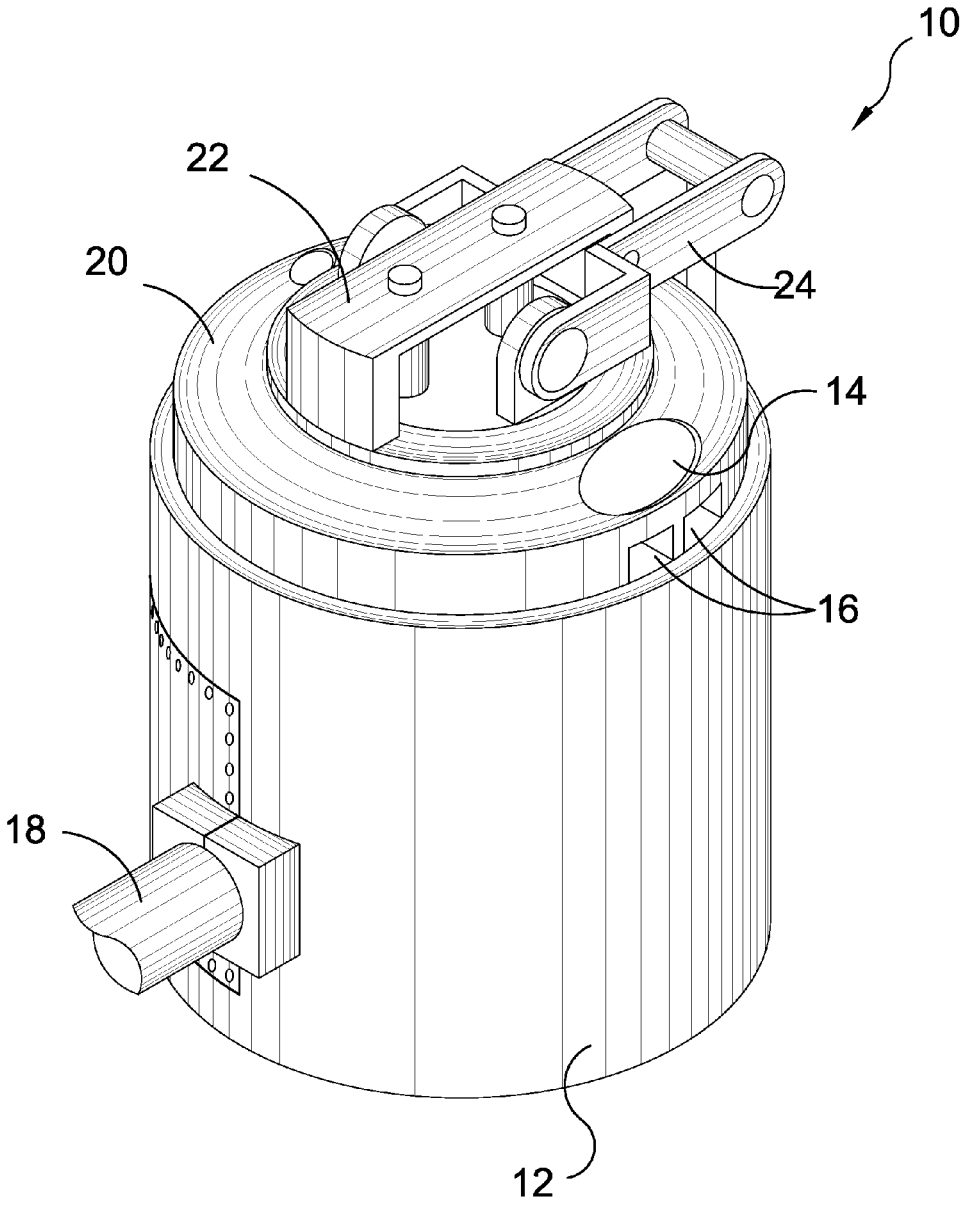
FIG. 1 is a perspective view of the present invention.

Turning now descriptively to the drawings, in which similar reference characters denote similar elements throughout the several views, the figures illustrate the Steam Turbine Engine of the present invention. With regard to the reference numerals used, the following numbering is used throughout the various drawing figures.

10 Steam Turbine Engine of the present invention
12 lower housing
14 inlet port
16 exhaust port
18 crank shaft
20 upper manifold
22 structural bridge
24 lever arm
26 retaining pin
30 central retainer
32 upper sealing gate
34 lower sealing gate
36 piston
38 spring
40 cam
42 piston rod
44 push rod

DETAILED DESCRIPTION OF THE PREFERRED EMBODIMENT

The following discussion describes in detail the present invention. For definition of the complete scope of the invention, the reader is directed to appended claims.

FIG. 1 is a perspective view of the present invention 10. Shown is the present invention 10 having a lower housing 12 with a compact design that can be manufactured to any size accordingly. Additionally shown is the present invention having multiple inlets 14 and outlets 16 for intake and exhaust stages so that multiple steam sources may be combined into the device if desired. Also shown is the crank shaft 18 and the relation ship of the upper manifold 20 with the structural bridge 22 and the lever arm 24.

Figure 2:
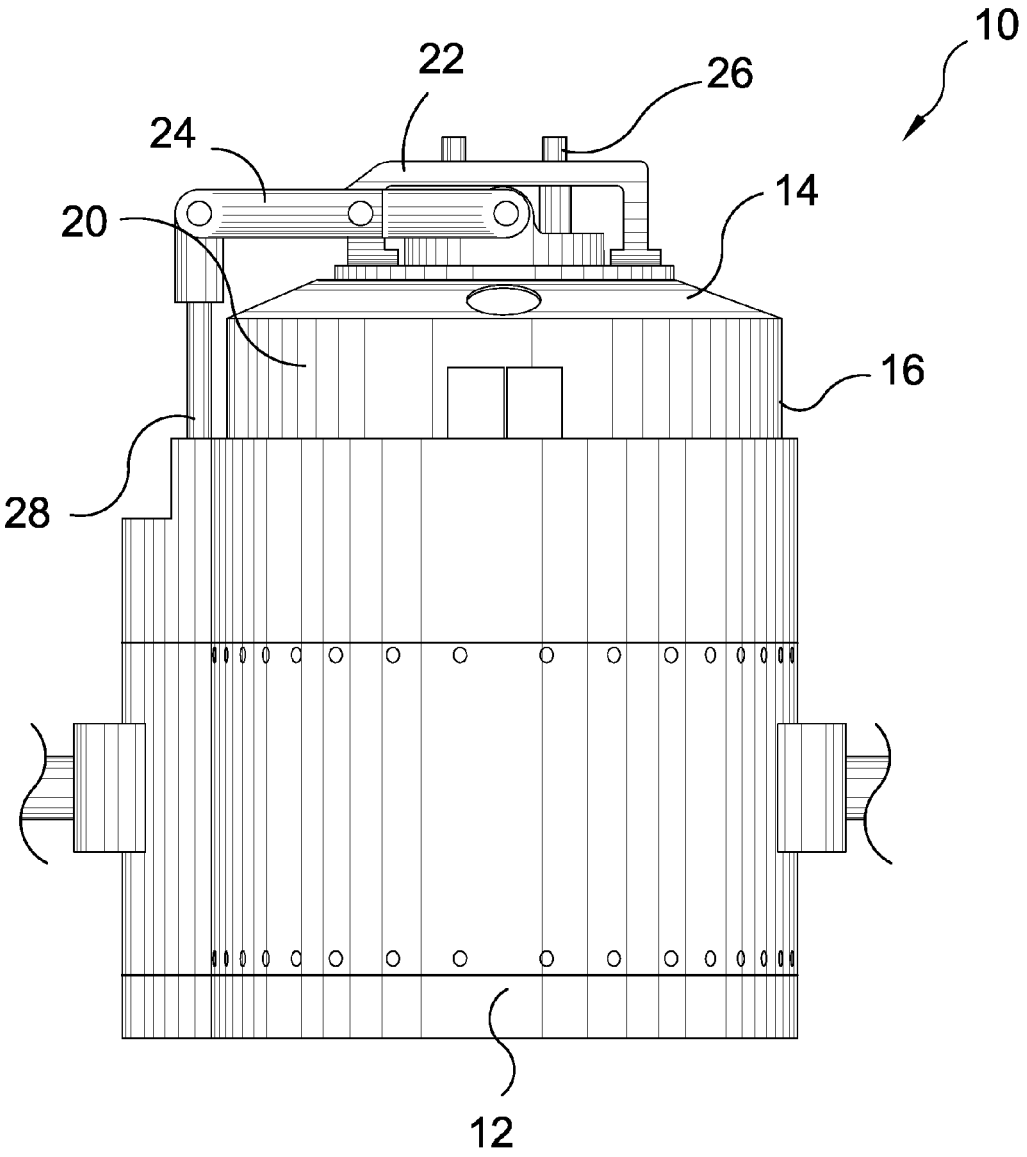
FIG. 2 is a side view of the present invention.

FIG. 2 is a side view of the present invention 10. Shown is the side profile of the present invention showing how the present invention has a substantially cylindrical shape and compact design. Shown are the lower housing 12 and upper manifold 20 with intake 14 and outlet 16 ports. Also shown are the structural bridge 22, retaining pin 26, lever arm 24 and the push rod 28.

Figure 3:
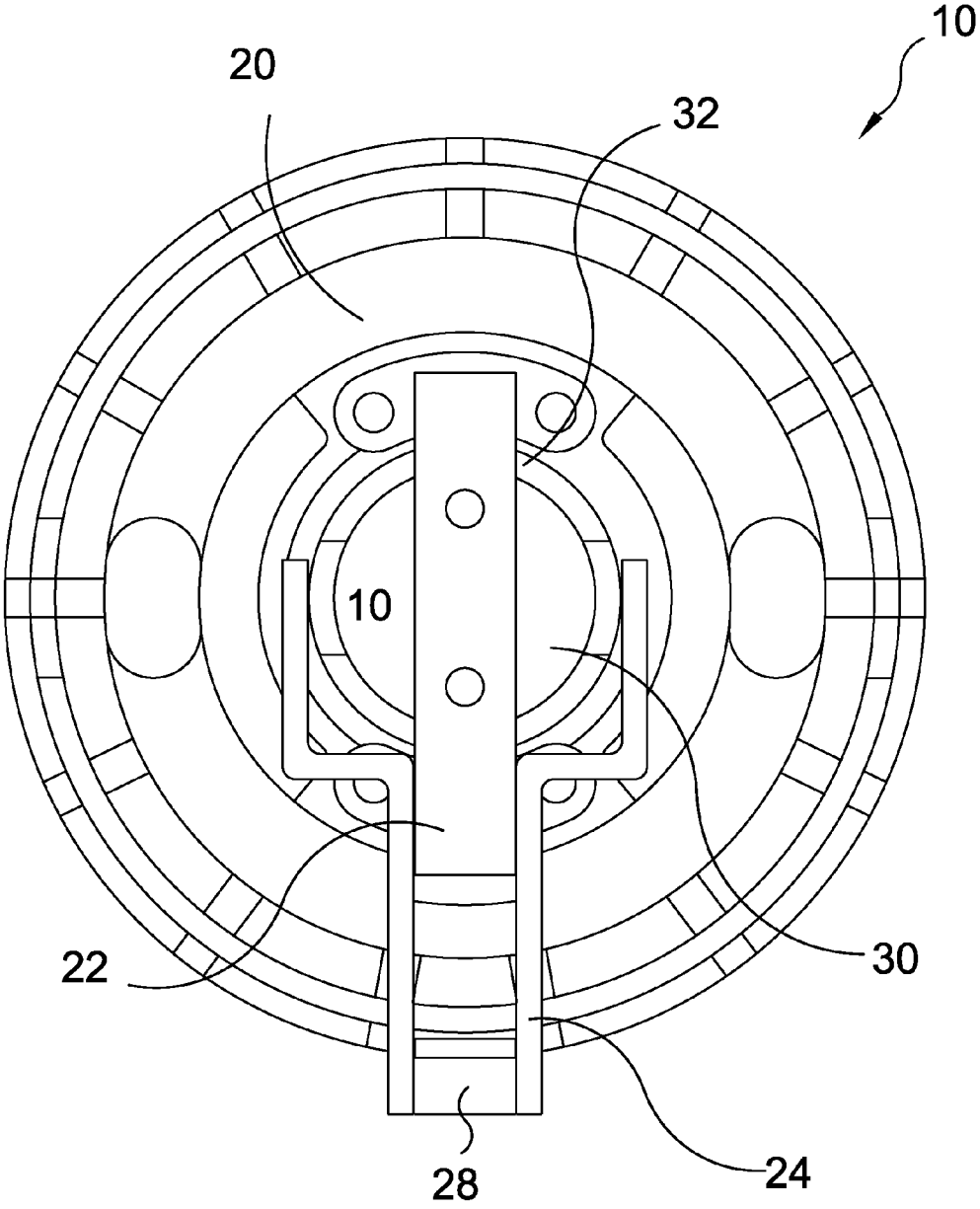
FIG. 3 is a top view of the present invention.

FIG. 3 is a top view of the present invention 10. Shown is the top of the present invention having a structural bridge 22 and two retaining pins 26 for supporting a central retainer 30, and also to serve as a fulcrum for the lever arms 24 attached to the push rod 28. This structural bridge is fixed to the upper manifold 20 and allows for the lowering and raising of the upper sealing gate 32 in cooperation with the pivotal functioning of the lever arm.

Figure 4:
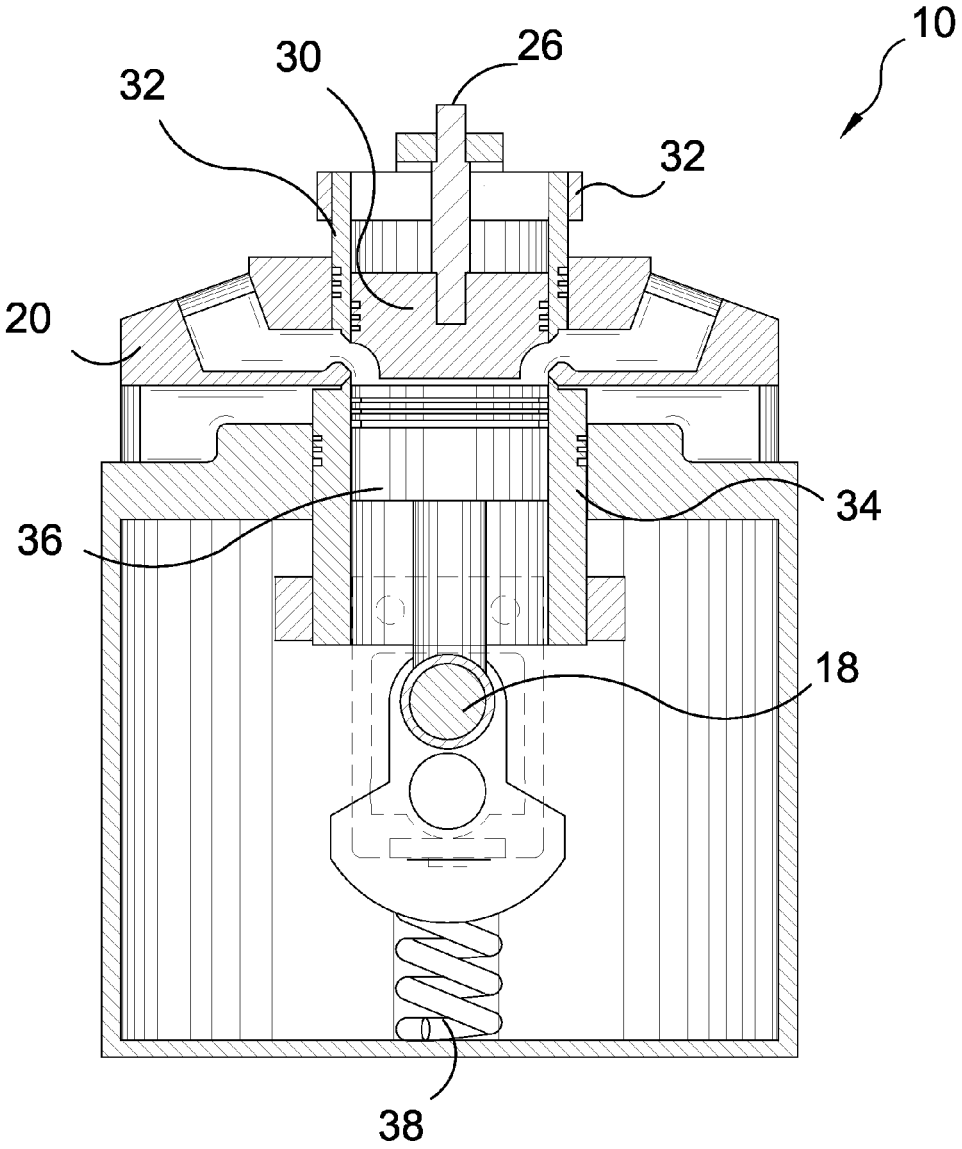
FIG. 4 is a sectional view of the present invention.

FIG. 4 is a sectional view of the present invention 10. Shown is the internal components of the present invention and how they relate to one another. The upper 32 and lower 34 sealing gates are connected to lever arms and cam systems with springs 38 in order to move up or down when needed during a cycle. The lower sealing gate 34 moves about in relation in-between a crank shaft 18 supported piston 36 held inside while the upper manifold 20 and cam linkages retain the outsides. For the upper sealing gate a retention pin 26 and structural bridge 22 provide support for a central retainer 30 to support the inside portions of the upper lift gate, along with an opening in the top of the upper manifold 20 for supporting the outsides of the upper lift gate.

Figure 5:
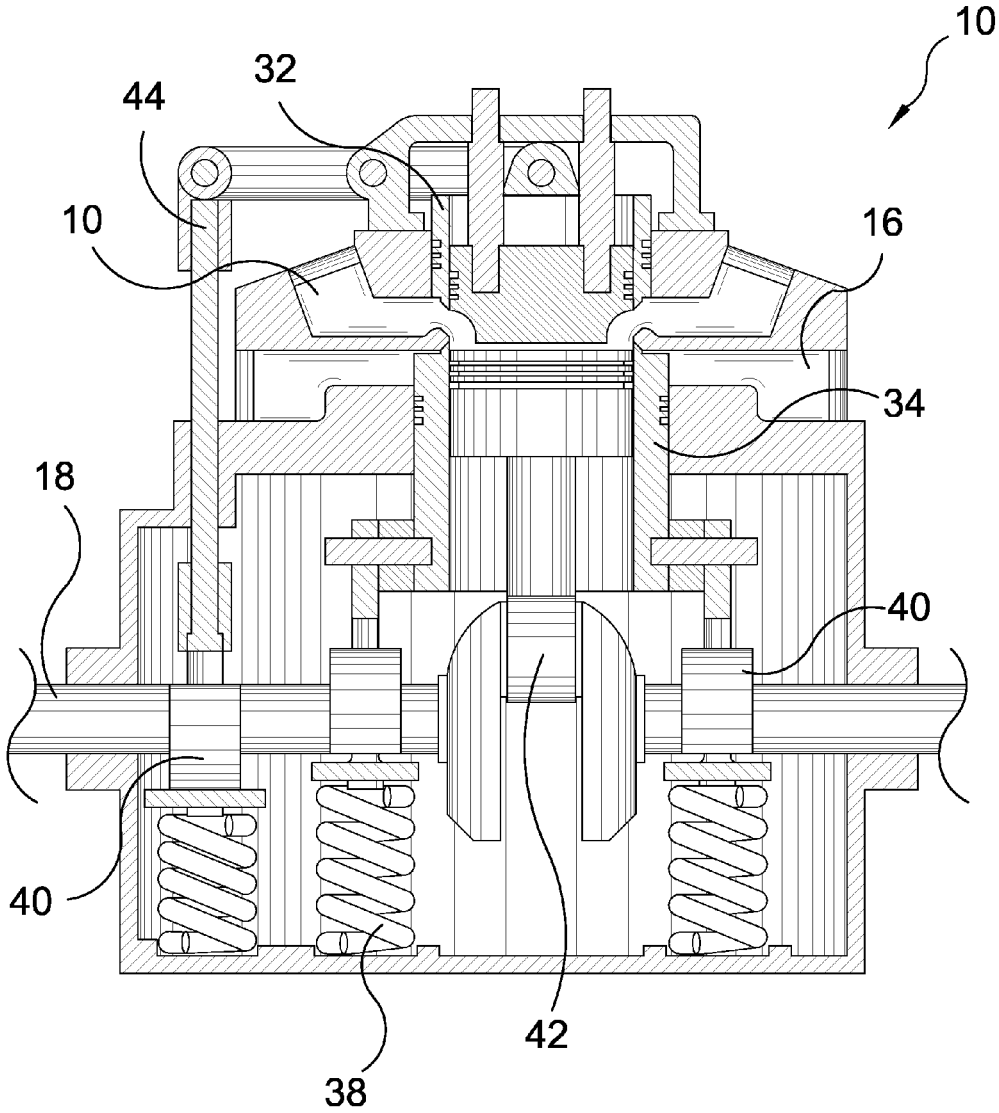
FIG. 5 is an illustrative view of the present invention during the intake phase.

FIG. 5 is an illustrative view of the present invention 10 during the intake phase. Shown is the steam engine turbine of the present invention utilized in the conversion of a high pressure steam source into rotative mechanical torque in a highly efficient manner. The device utilizes two primary stages with the system having an optimum intake stage that translates into an optimum release or exhaust stage respectively. As the upper sealing gate 32 raises due to the lever arm 24 responding to the push rod 44 and opening the intake port 14, the lower sealing gate 34 also rises due to cams 40 and springs 38, along with it in order to seal the exhaust or outlet ports 16 simultaneously. The piston rod 42 serves to rotate the crank shaft 18 and associated cams 40.

Figure 6:
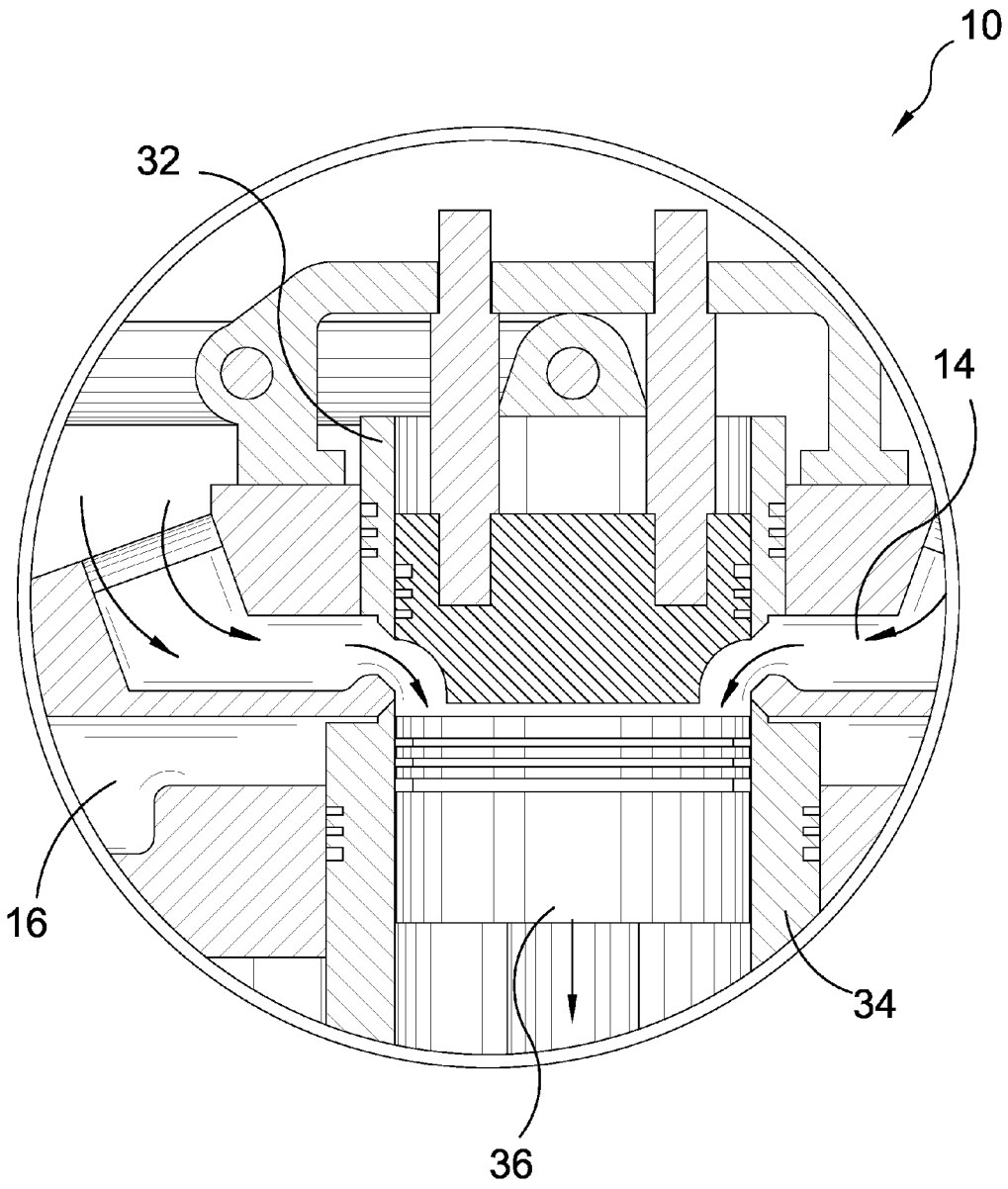
FIG. 6 is a detailed sectional view of the present invention.

FIG. 6 is a detailed sectional view of the present invention 10. Shown is a detailed view of the present invention depicting that when the piston 36 is at top dead center the upper sealing gate 32 and intake port 14 is fully open while the lower sealing gate 34 and exhaust port 16 is closed. Coming from a high pressure source this is equivalent to an intake or ignition stroke for a two cycle engine design. This stage creates downward force on the piston 36 forcing it to make a power stroke.

Figure 7:
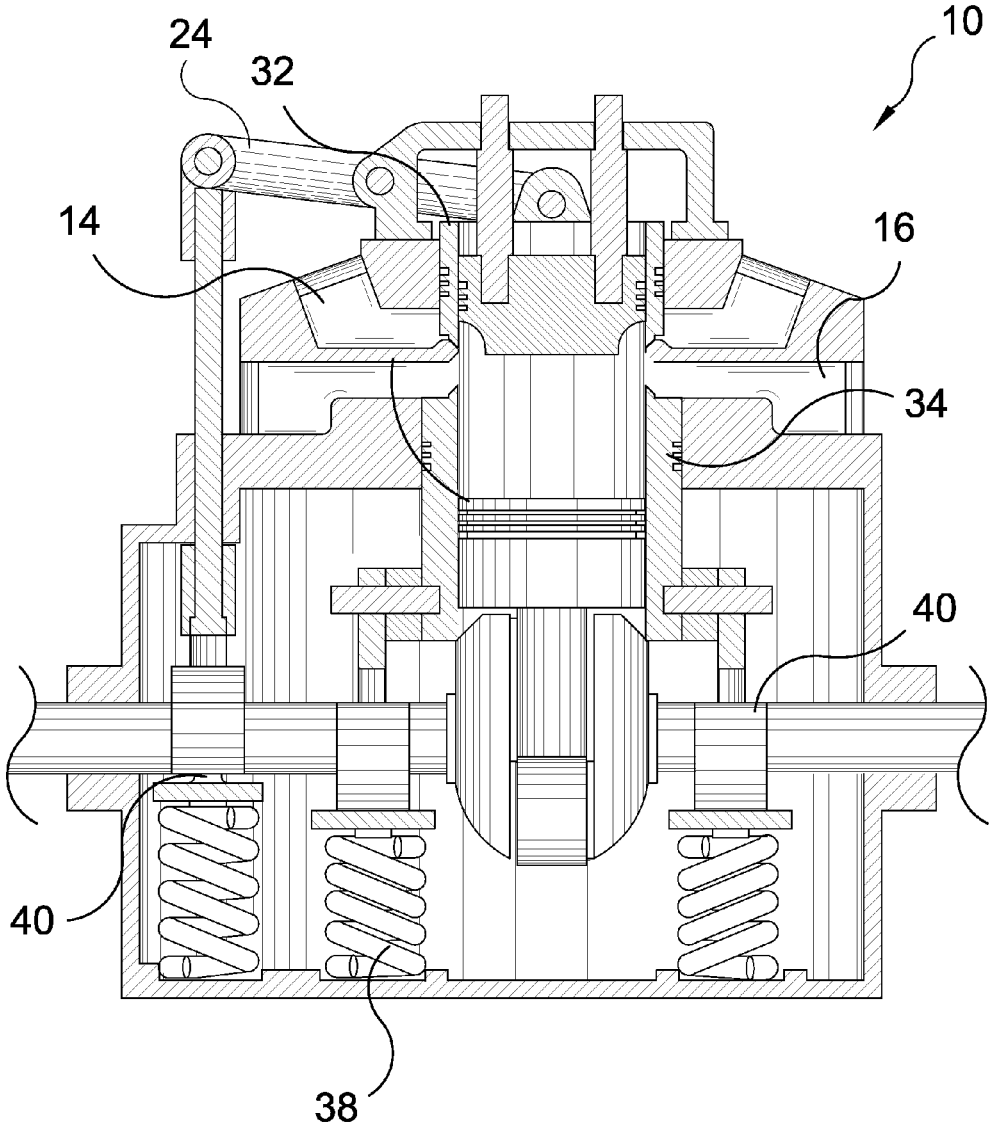
FIG. 7 is a sectional illustrative view of the present invention in the exhaust phase.

FIG. 7 is a sectional illustrative view of the present invention 10 in the exhaust phase. Shown is the present invention comprising a steam engine turbine utilized in the conversion of a high pressure steam source into rotative mechanical torque. The device utilizes two primary stages having an optimum intake stage that translates into an optimum release or exhaust stage respectively. As the upper sealing gate 32 lowers it closes the intake 14 due to the lever arm 24 while the lower sealing gate 34 also lowers due to a plurality of cams 40 and springs 38 in order to open the exhaust or outlet ports 16 simultaneously.

Figure 8:
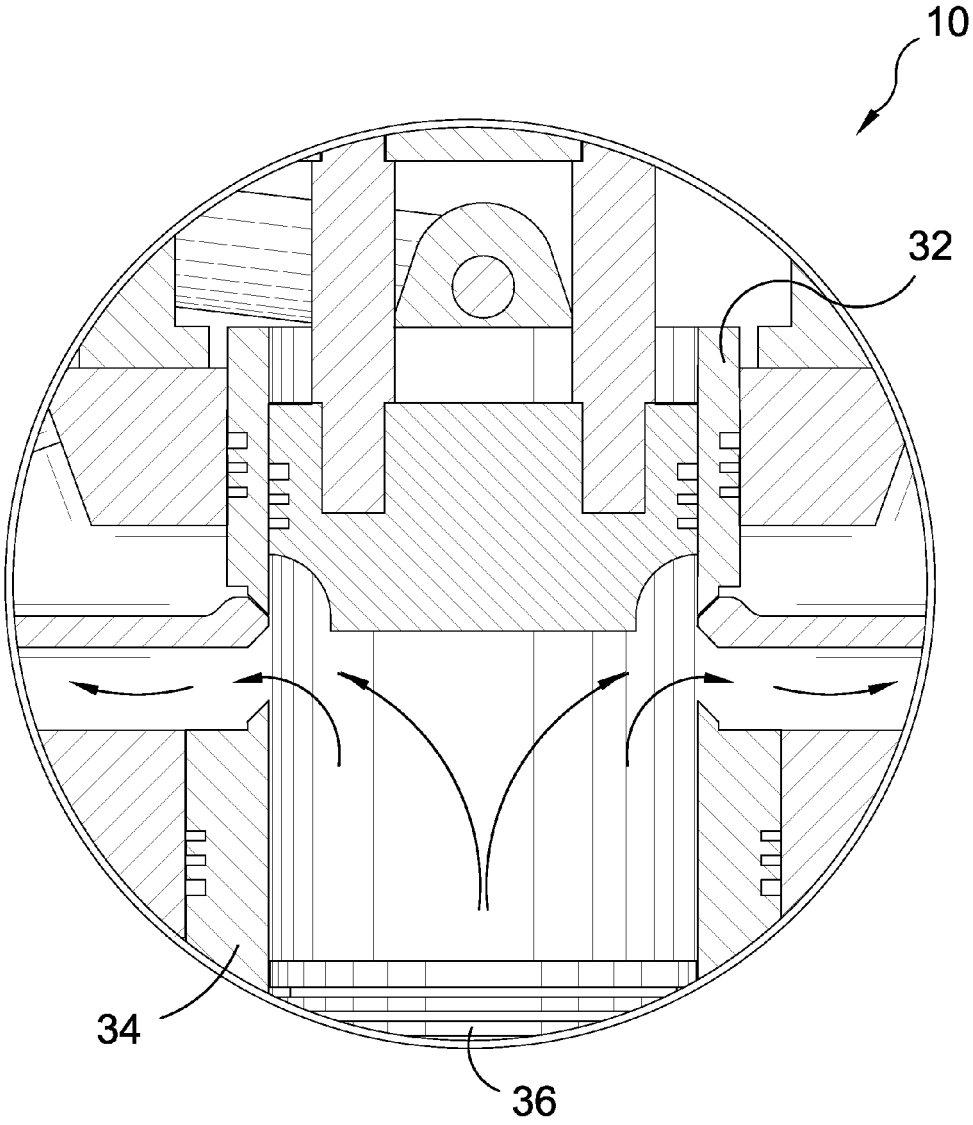
FIG. 8 is a detailed sectional view of the present invention.

FIG. 8 is a detailed sectional view of the present invention 10. Shown is a detailed view of the present invention depicting that when the piston 36 is in the bottom position the upper sealing gate 32 is fully closed while the lower sealing gate 34 is opened. Coming from a high pressure source this is equivalent to exhaust or outlet stroke for a two cycle engine design. This stage relieves pressure and helps return the piston back to the top position using momentive force.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A steam turbine engine comprising:

a) a lower housing and an upper manifold;

b) at least one intake port;

c) at least one exhaust port disposed inferior to said intake port;

d) a central retainer disposed on said upper manifold;

e) a structural bridge secured to said central retainer with a pair of retaining pins;

f) a piston disposed within said lower housing;

g) a piston rod projecting from the bottom of said piston;

h) a crank shaft rotatively secured to said piston rod;

i) a cam and spring system affiliated with said crank shaft;

j) a lever arm;

k) a push rod communicating between said lever arm and its associated cam;

l) an upper sealing gate raised and lowered by said lever arm; and m) a lower sealing gate;

n) wherein the piston is at top dead center with the upper sealing gate fully open and said lower sealing gate fully closed when in the static position; and o) wherein said intake stroke is initiated with the introduction of highly pressurized steam into said intake port and through said open upper sealing gate.

2. The steam turbine engine according to claim 1, wherein said pressurized steam creates a downward force on said piston forcing it into a power stroke.

3. The steam turbine engine according to claim 2, wherein said lever arm moves said upper sealing gate closes to block said intake port.

4. The steam turbine engine according to claim 3, wherein said lower sealing gate opens due to the spring and cam system.

5. The steam turbine engine according to claim 4, wherein said engine enters the optimum exhaust stage.

6. The steam turbine engine according to claim 5, wherein the internal pressure is relieved and said piston returns to the top using momentive force.

7. The steam turbine engine according to claim 6, wherein said lower sealing gate blocks said exhaust port, said upper sealing gate opens to said intake port and the process is repeated.

* * * * *